US009334685B1

(12) United States Patent
DeMoore et al.

(10) Patent No.: US 9,334,685 B1
(45) Date of Patent: May 10, 2016

(54) ENVIRONMENTAL BARRIER

(71) Applicant: Howard W. DeMoore, Dallas, TX (US)

(72) Inventors: Howard W. DeMoore, Dallas, TX (US); William Edward Starr, Dallas, TX (US)

(73) Assignee: Howard W. DeMoore, Dallas, TX (US)

( * ) Notice: Subject to any disclaimer, the term of this patent is extended or adjusted under 35 U.S.C. 154(b) by 0 days.

(21) Appl. No.: 14/606,192

(22) Filed: Jan. 27, 2015

(51) Int. Cl.
*E04B 7/00* (2006.01)
*E04H 12/28* (2006.01)
*E06B 7/26* (2006.01)

(52) U.S. Cl.
CPC ..... *E06B 7/26* (2013.01)

(58) Field of Classification Search
CPC ..... E06B 7/26; E06B 7/03; E06B 2009/524; E06B 2009/2405
See application file for complete search history.

(56) References Cited

U.S. PATENT DOCUMENTS 2,079,967 A * 5/1937 Rindt ..... E06B 7/26 454/196
2,082,209 A * 6/1937 Mason ..... E06B 7/26 454/214
2,179,541 A * 11/1939 Burke ..... E06B 7/26 160/131
2,498,095 A * 2/1950 Risney ..... E06B 7/26 160/127
2,503,849 A * 4/1950 Smith ..... E06B 7/26 160/369
2,808,774 A * 10/1957 Camerino ..... E06B 7/26 454/213
3,099,950 A * 8/1963 Christian ..... E06B 7/26 454/215
3,116,519 A * 1/1964 Keith ..... E06B 7/26 454/226
4,792,169 A * 12/1988 Petry ..... E05B 65/0888 292/276
4,899,646 A * 2/1990 Maras ..... E06B 7/26 454/215
5,105,868 A * 4/1992 Riise ..... E06B 7/32 160/179
5,997,982 A * 12/1999 Susat ..... G08B 5/00 156/94
7,165,596 B1 * 1/2007 Helton ..... E06B 7/26 160/222
2009/0173012 A1 * 7/2009 Luca ..... E05F 5/003 49/503
2010/0197214 A1 * 8/2010 Geremia, Sr. ..... E06B 7/03 454/195
2013/0092331 A1 * 4/2013 Johnsen ..... E06B 7/30 160/351

* cited by examiner

*Primary Examiner* — Brian Mattei

(57) ABSTRACT

A method of preventing liquid from entering a partially opened window or door (e.g., during a rain storm) comprises redirecting an airflow containing a liquid, through a window or door screen, using a water impermeable barrier to allow the passage of fresh air. A portion of the liquid is deflected by the barrier. The method also comprises receiving, via an upper passageway defined between the barrier and the window, the airflow, directing the airflow from the passageway to the opening, reducing an additional portion of the liquid in the airflow in response to the directing of the airflow to the opening. The barrier can be coupled to or integrated into the screen material, and the screen can have stripes or other visual indicators as a safety factor to indicate the presence of the screen.

7 Claims, 9 Drawing Sheets

ENVIRONMENTAL BARRIER

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Windows provide interior spaces with exposure to natural light and act as a barrier to various environmental elements when the windows are closed. Opening a window may allow for entry of air into a room; however, the open window may also provide a direct path for elements to enter, such as insects or rain. Window screens (e.g., meshes or other permeable membranes) may control the passage of larger insects when the window is open, but screens themselves are permeable and thus may still allow moisture to pass across their structure. Thus, when a window is open during a rain storm, wind may drive rain into the room where the window is located.

SUMMARY

In an embodiment, a system is disclosed. The system may include a water mitigation system for use with a window. The system comprises a window, a window screen, and a substantially water impermeable barrier. The window is disposed in a window frame, and the window defines an opening within the window frame. The window screen comprises an air-permeable barrier, the air-permeable barrier being configured to cover at least a portion of the window frame. The window screen is disposed substantially parallel to the window frame. Additionally, the substantially water impermeable barrier is configured to attach to the window screen. The barrier overlaps a predefined portion of the air-permeable barrier of the window screen, and the barrier includes a body member that provides a substantially water impermeable barrier within the predefined portion. The body member couples to the window screen and is disposed along the window screen at the predefine portion. The barrier and the window are arranged to define an upper passageway between the barrier and the window, and the upper passageway is open to and in fluid communication with the atmosphere outside of the window screen.

A system is disclosed according to another embodiment. The system may mitigate liquid passage across a threshold of a window unit. The system comprises a window screen and a liquid barrier. The window screen comprises a semi-permeable barrier, and the semi-permeable barrier is configured to cover at least a portion of a window. The window is operable to define an opening within a window frame. Additionally, the liquid barrier is coupled to the window screen. The liquid barrier comprises a first member, at least one sidewall member, an internal passageway, and a flange member. The first member comprises a first end, a second end, a top portion, a bottom portion, an outer surface, an inner surface, a length between the first and second ends, and a slot. The slot is defined along the length and between the top portion, bottom portion, outer surface, and inner surface. A sidewall member is rigidly coupled upon, and transversely aligned to, each of the first end and second end of the first member. Each sidewall member comprises an outer surface and an inner surface. The internal passageway includes a ceiling and sides. The ceiling and sides are defined by the inner surfaces corresponding with each of the first member and each of the sidewall members. The flange member is rigidly coupled upon each sidewall member. Each flange member respectively extends from the inner surface of the corresponding sidewall member. Each flange member also respectively extends towards a centerline of the first member, and is dimensioned to overlap and mate to the window screen. Additionally, each flange member is configured to affix the liquid barrier to the window screen along a surface of each flange member that is substantially parallel to the semi-permeable barrier.

In an embodiment, a method is disclosed. The method reduces water passage through a window opening. The method comprises deflecting an airflow through a semi-permeable barrier of a window screen at a predefined portion using a liquid barrier. The airflow comprises a liquid. The liquid barrier is affixed to the window screen, and the predefined portion is defined by an overlap of the liquid barrier and the semi-permeable barrier. The window screen is disposed over an opening comprising a window. The method further includes removing a portion of the liquid in the airflow on the liquid barrier in response to the deflecting. The method includes receiving the airflow via an upper passageway. The upper passageway is defined between the liquid barrier and the window. The method also comprises directing the airflow from the upper passageway to the opening. The method includes removing an additional portion of the liquid in the airflow on at least one of the window or an outside window sill in response the directing of the airflow to the opening. Additionally, the method further comprises directing liquid out of the air flow path prior to crossing a threshold. The threshold is defined by a plane of the opening that is bounded at least by a window frame, and the liquid barrier is disposed outside of the plane of the threshold. Moreover, the method includes receiving, across the plane of the opening of the window, the airflow with the liquid substantially removed.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
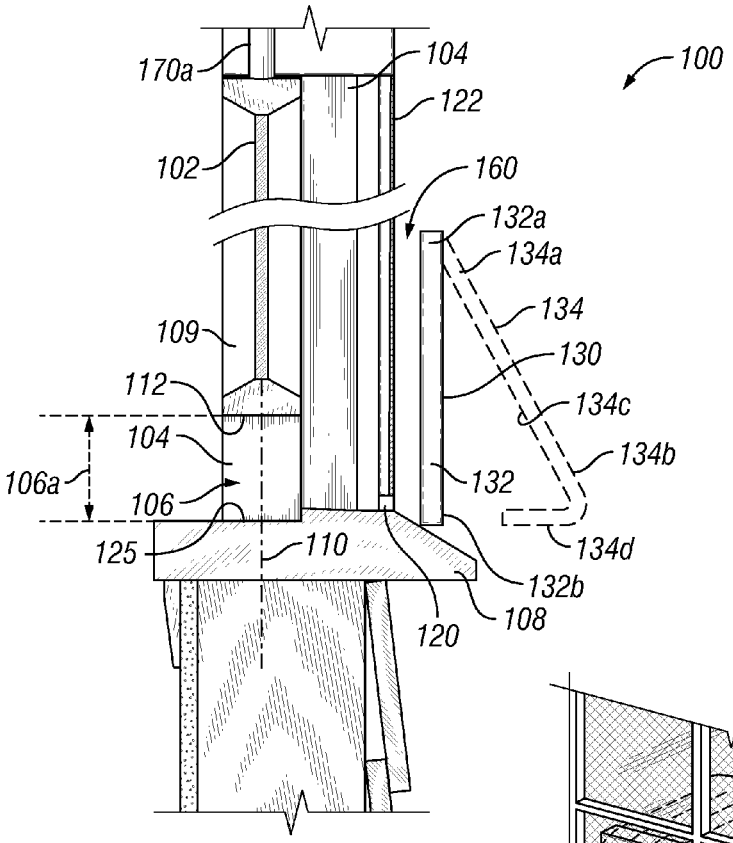
FIG. 1A illustrates an exemplary system according to an embodiment of the disclosure.
Figure 1B:
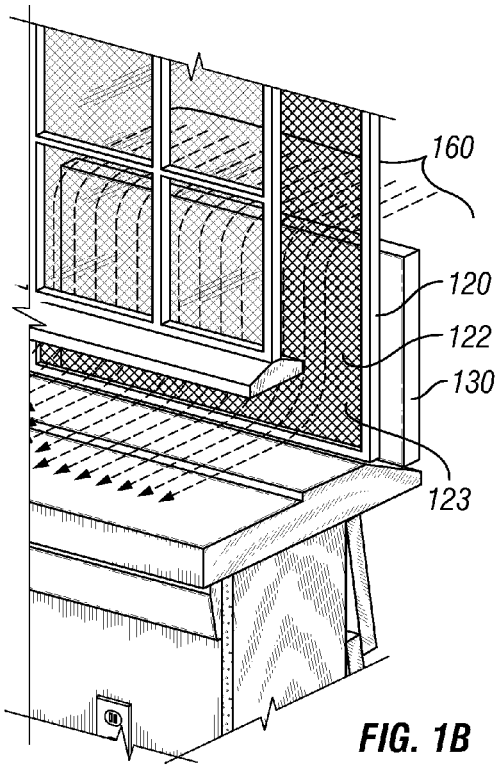
FIG. 1B shows another view of the exemplary system in FIG. 1A.
Figures 1C, 1H, 1I, 1J:
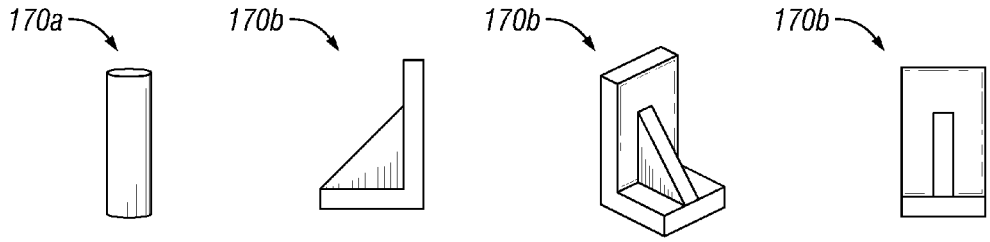
FIG. 1C is an illustration of an obstruction member according to one embodiment of the exemplary system in FIG. 1A.
FIGS. 1H, 1I, and 1J are illustrations corresponding to another embodiment of an obstruction member for use in the exemplary system of FIG. 1A.
Figure 1D:
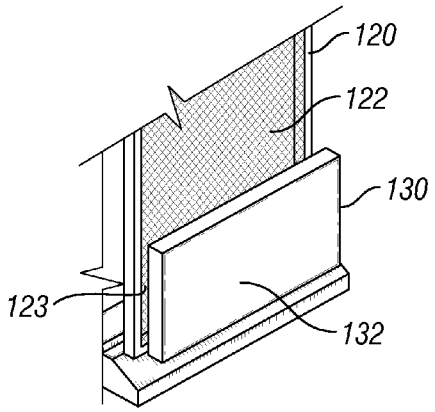
FIG. 1D shows another view of the exemplary system in FIG. 1A.
Figure 1E:
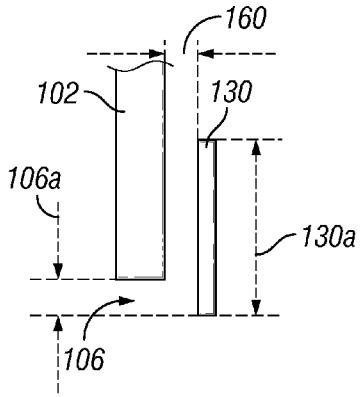
FIG. 1E illustrates an exemplary height ratio for various embodiments of the exemplary system in FIG. 1A.
Figure 1F:
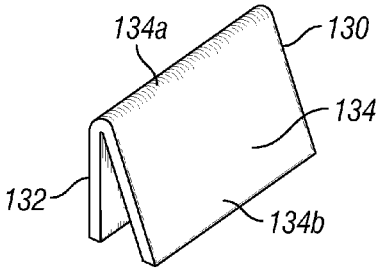
FIG. 1F illustrates another embodiment of a barrier for use in embodiments of the exemplary system in FIG. 1A.

A homeowner may desire to install decorative window treatments (e.g., curtains, blinds, valances, etc.) near the interior facing portion of a window. These window treatments may allow the window to be in an open position despite obstructing at least part of the window and/or a window opening. For example, a window may be decorated with vertical curtains that hang on each side of the window pane. The curtains may partially obstruct the interior face of the window even when the curtains are fully open. Thus, a window may be opened a few inches to provide ventilation while also allowing for the curtains to be at least partially drawn together. This means that on a bright but cool summer day, the homeowner can open the window to allow the breeze inside while also partially drawing the curtains closed to block at least some of the light. A homeowner may act in a similar manner if vertical or horizontal blinds are used while the window is open. Yet if a rain storm rolls into town, the open window may allow for the wind to carry rain into the room. This may cause water to accumulate on expensive hardwood floors, pool water at the opening, and damage window treatments that are not designed to withstand the effects of moisture. Moreover, the homeowner may not be able to use an air-conditioning device (e.g., HVAC systems, fans, etc.) if the power goes out, thus causing the air to become stagnant and undesirable.

Accordingly, the present disclosure provides an environmental barrier that mitigates entry of a liquid through a window opening. The environmental barrier can be placed adjacent to, but offset from, an opening in a window to create a pathway from an exterior of a structure to the interior of the structure through the window opening that passes over the environmental barrier and through the window opening. The barrier and opening can overlap to cause air that may have a liquid therein to change direction as it passes into the interior of an opening, thereby causing the liquid within the air to be removed. For example, the environmental barrier can attach to a window screen, which in turn can be coupled to a window unit. The environmental barrier can be positioned such that the bottom portion of the window screen is covered, along with a corresponding portion of the window unit that opens to allow air into a room. This allows for visibility through the window, while also preserving the functionality of the window screen by blocking out insects. The environmental barrier may attach to the window screen in a removeable manner, thus preserving the structural integrity of the window unit and its framing. The environmental barrier may be manufactured according to the width of the window opening or window frame in order to ensure adequate coverage. In some embodiments, the environmental barrier may be expandable along its length, and thus may adjust according to the particular size of the window opening. When attached to the window screen, the environmental barrier creates and defines an upper passageway between the barrier and the window, with the height of the environmental barrier being taller than the height of the window opening. The environmental barrier is substantially water impermeable and the barrier is configured to deflect liquid away from the window opening, and towards a window sill below the barrier.

Moreover, with the environmental barrier affixed to the window screen, the window can be closed within the window unit without having to move or reposition the environmental barrier. This may be advantageous because if a homeowner decides to open the window during an ongoing rainstorm, the environmental barrier provides continuous protection over a defined height ratio. Thus, airflow is received through the opening of the window with the liquid substantially removed and may keep the threshold of the window opening within a structure substantially dry. In some embodiments, the environmental barrier may include a shield member that, in conjunction with sidewalls, defines an internal passageway. The environmental barrier may include a cavity shield that further defines and directs airflow within the internal passageway. The cavity shield is oriented below the shield at an entrance of the internal passageway, and further deflects water from the entrance if a sudden surge of wind catches water from below the environmental barrier towards the lower portion of the barrier. The combination of the internal passageway and the upper passageway can provide two avenues of air flow through the opening, each allowing air to travel along a flow path and pass through the opening with water substantially removed from the flow path. Thus, even while it is raining outside prior to opening the window, the environmental barrier provides protection from liquid entering a room during the process of opening the window, and also being configured to allow a homeowner to adjust and substantially reduce the height of the window opening with the environmental barrier in place without water passing across the window threshold.

Turning now to FIGS. 1A-1J, a system 100 is discussed that illustrates an embodiment of the present disclosure. In an embodiment, the system 100 comprises a window 102, a window screen 120, and a substantially water impermeable barrier 130. The window 102 may be disposed within a window frame 104, with the window frame substantially surrounding and providing a boundary for the window 102 and the window opening 106. As described herein, the collection of at least window 102, window frame 104, and window sill 108 may be occasionally referred to as a window unit. The window 102 has a width running between the window frames 104, which are generally disposed vertically. The window 102 may comprise a window sash 109 which is operable within a plane 110 of movement within the window frame 104. In an embodiment, the window sash 109 may be considered a moveable framework of the window 102, and may move (e.g., slide, roll, etc.) within plane 110. As illustrated in FIG. 1, the plane 110 is oriented vertically and substantially parallel to the window screen 120 and between the window frames 104. The window frame 104 includes a mating surface 125. The mating surface 125 opposes and mates with a sealing surface 112 of the window sash 109. The mating surface 125 may comprise any of a window sill, a window channel, and/or a window casing. The window sill 108 is a horizontal bottom member of the window frame 104, and is oriented below window screen 120 and an environmental barrier (e.g., substantially water impermeable barrier 130). The window opening 106 is defined between the mating surface 125 and the sealing surface 112 and bounded on the edges by the window frame 104—that is, in the illustrated embodiment, along the bottom of the window unit. The plane 110 may define a threshold of the opening 106, with the threshold being a demarcation between the interior of a building (or other protected space of the window 102) and the exterior environments exposed to rain and natural weather. The window unit may be a single hung window, a double hung window, a hinged window, a louvered window, and/or the like.

The opening 106 has a height 106*a* that may increase or decrease based on the extent to which the window 102 is moved within the window frames 104. The window 102 (and/or window sash 109) may be occasionally referred to as being open where a separation—height 106*a*—between mating surface 125 and sealing surface 112 is such to allow an airflow to pass through the opening 106), or closed where a separation between—height 106*a*—between mating surface 125 and sealing surface 112 is such so as to substantially prevent, or limit, an airflow from passing through the opening 106. The width of opening 106 may correspond with the length of an environmental barrier (e.g., 130, 230 as discussed below). In some embodiments, a window unit may comprise a window stool, which is a horizontal member coupled with a window sill (e.g., window sill 108). The window stool may be configured to be fitted against a window sash and between window frames. The window stool may be located on the interior of the building (i.e., on the side of the window unit that is not directly exposed to weather and environmental elements when the window is closed.

Although FIG. 1A illustrates an embodiment having opening 106 shown with a height 106*a* in the vertical direction, alternative embodiments are contemplated, such as a system with a window that moves and opens horizontally so as to comparatively create an opening along a substantially vertical edge of the window frame.

The system 100 includes the window screen 120 that couples to the window unit (e.g., coupling to window frame 104, window sill 108, or other structure adjacent to the window 102). The window screen 120 may comprise a semi-permeable barrier that allows at least some particles, fluids (e.g., either in a gaseous and/or liquid state) to pass through a barrier that makes up the semi-permeable barrier. The window screen 120 can be formed from a woven or cast metal, fiberglass, polymer, or similar material to form a screen-like structure having openings that are generally configured to prevent the entry of large particles, insects, and the like while allowing air to pass through. A semi-permeable barrier includes an air-permeable barrier 122 that is configured to cover at least a portion of the window frame 104 (e.g., at least some of the edges of the window frame 104), and allows the passage of gases (e.g., air). The air-permeable barrier 122 is disposed according to the configuration of the window 102 and oriented according to where the opening 106 is defined. The window screen 120 may allow some amount of liquid (e.g., rain) to pass across the air-permeable barrier 122. The window screen 120 may be configured to removably affix to a window frame 104 or other parts of a window unit, thereby allowing for direct access to the outside of the window's surfaces that are exposed to rain and the environment.

The system 100 also includes an impermeable barrier 130 that is configured to affix to the window screen 120 through a variety of mechanisms, which are discussed below with respect to FIG. 4A-4Q. The impermeable barrier 130 is configured to couple at a substantially parallel orientation to the window screen 120 and/or the window frame 104. In an embodiment, the impermeable barrier 130 may be a substantially water impermeable barrier 130 that is configured to be substantially impermeable to water and thus deflect water from a surface of the barrier 130. The barrier 130 may include a body member 132 that has substantially rectangular dimensions and may be disposed so as to overlap a predefined portion 123 of the air-permeable barrier 122 of the window screen 120. The predefined portion 123 may be the lower (bottom) section of the window screen 120 that covers the window opening 106. Thus, the body member 132 couples to the window screen and defines the predefined portion 123 that protects water (e.g., rain, sprinklers, hoses, etc.) from crossing through the air-permeable barrier 122 of window screen 120 at the predefined portion 123.

The body member 132 has an upper portion 132*a* and a lower portion 132*b*, with the barrier 130 having a height 130*a*. The body member 132 may have a substantially uniform thickness, and may comprise rigid and/or flexible materials. The upper portion 132*a* is disposed above the lower portion 132*b* such that the lower portion is adjacently coupled to the bottom of the window screen 120. in some embodiments, the body member 132 may be oriented vertically above a sloping portion of the window sill 108. Although FIG. 1A illustrates barrier 130 having the body member 132 disposed on the outward-most face (side) of the window screen 120 (i.e., the side of the window screen that is facing the external environment such as a street, road, lawn), in some embodiments, the body member 132 may be disposed and affix to the complementary face (side) of the window screen (i.e., the side of the window screen that is facing towards the window 102 and towards the opening 106 that leads to an interior room through the window opening 106.

Figure 1G:
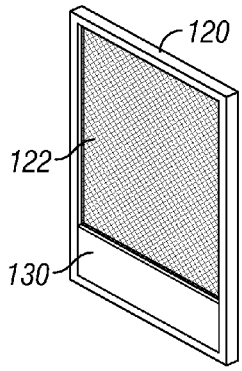
FIG. 1G illustrates an exemplary barrier for various embodiments of the present disclosure.
Figure 2:
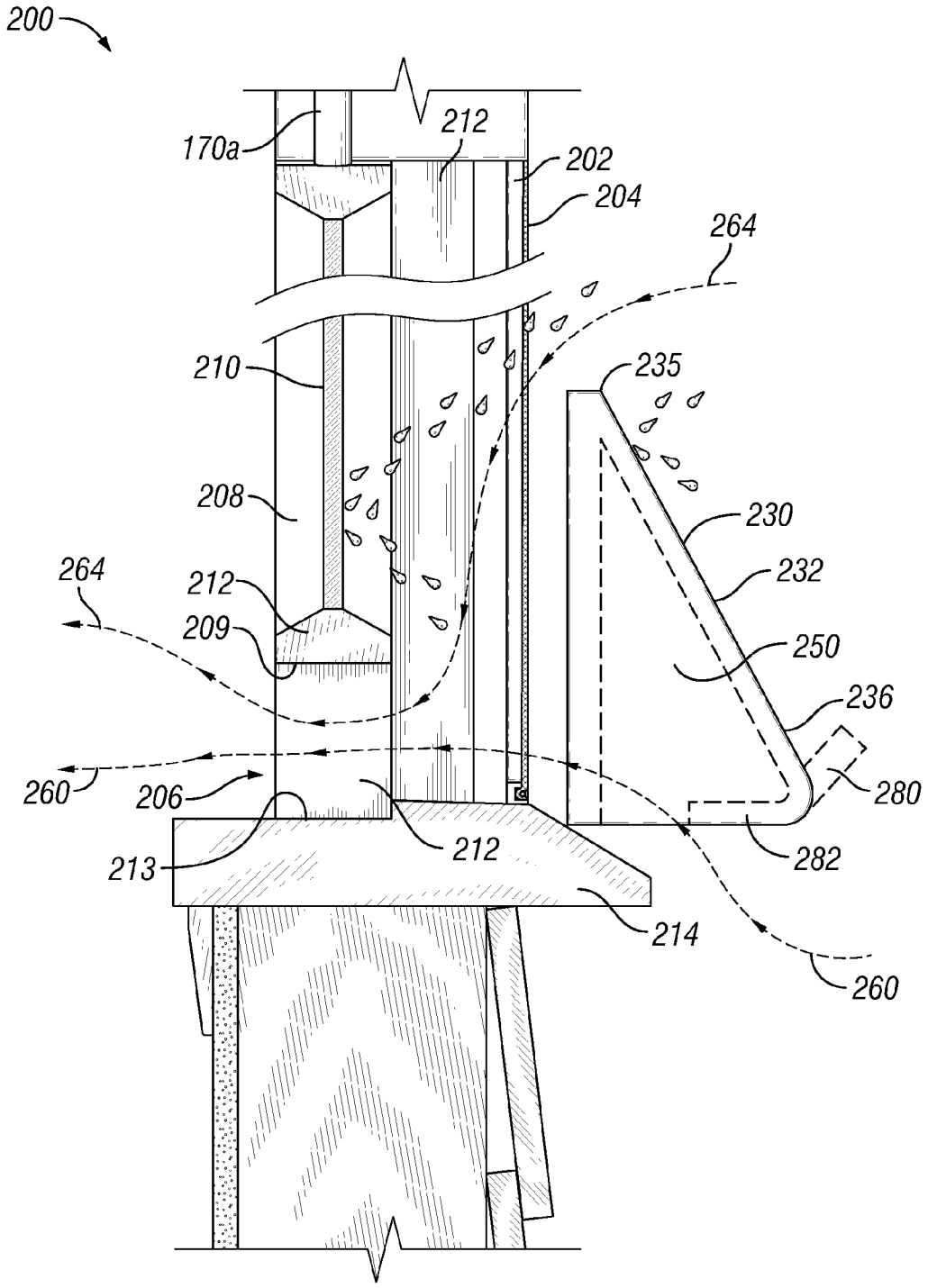
FIG. 2 illustrates another exemplary system according to an embodiment of the disclosure.
Figure 3A:
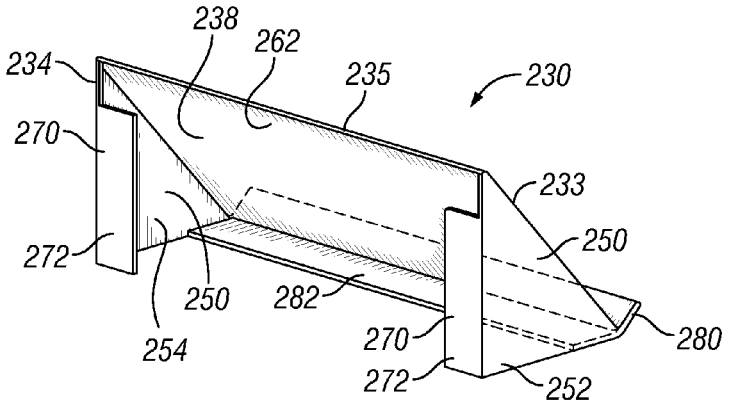
FIGS. 3A and 3B are further illustrations of an exemplary liquid barrier for various embodiments of the system shown in FIG. 2.
Figure 3B:
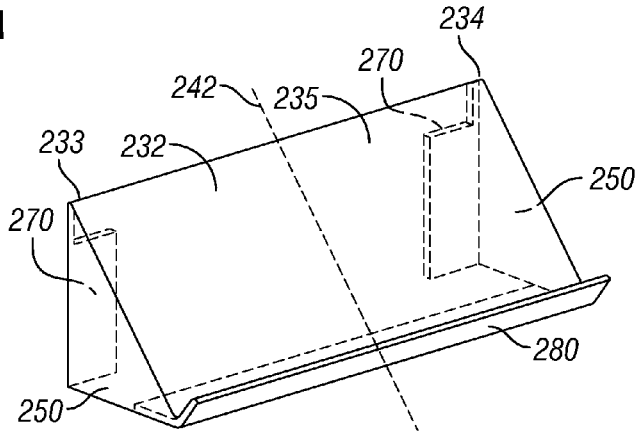
Figure 3C:
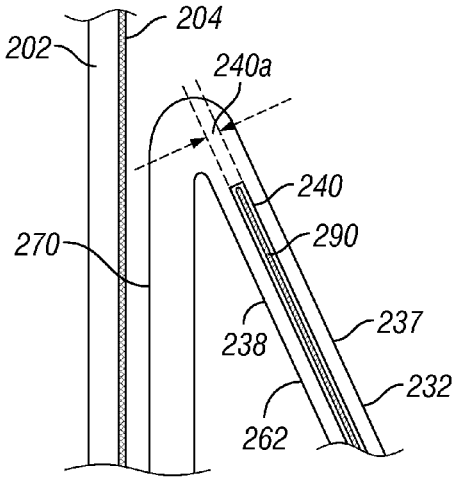
FIG. 3C illustrates an embodiment of the liquid barrier in FIGS. 3A and 3B.
Figure 3D:
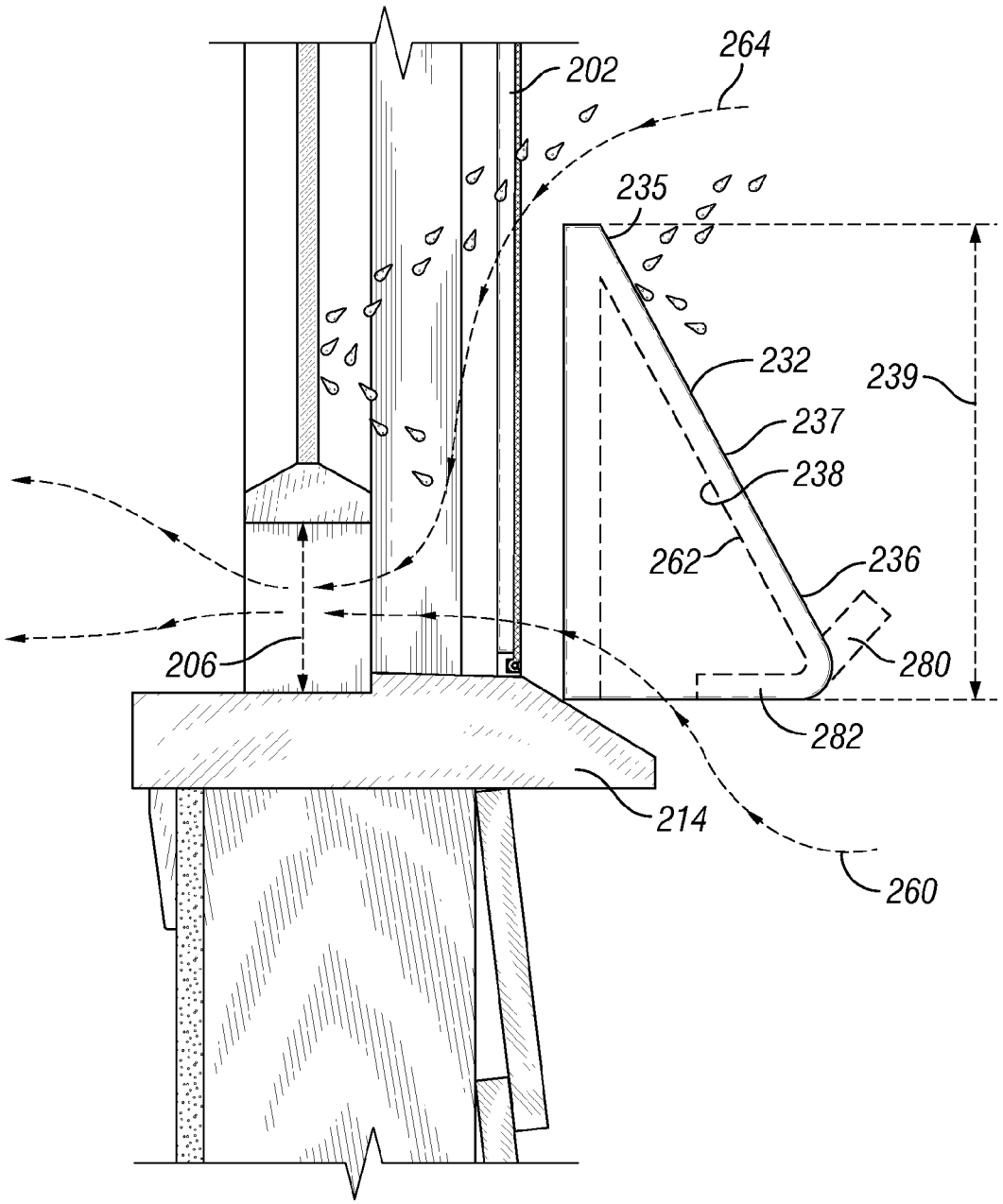
FIG. 3D illustrates an exemplary height ratio according to various embodiments of the system in FIG. 2.
Figure 3E:
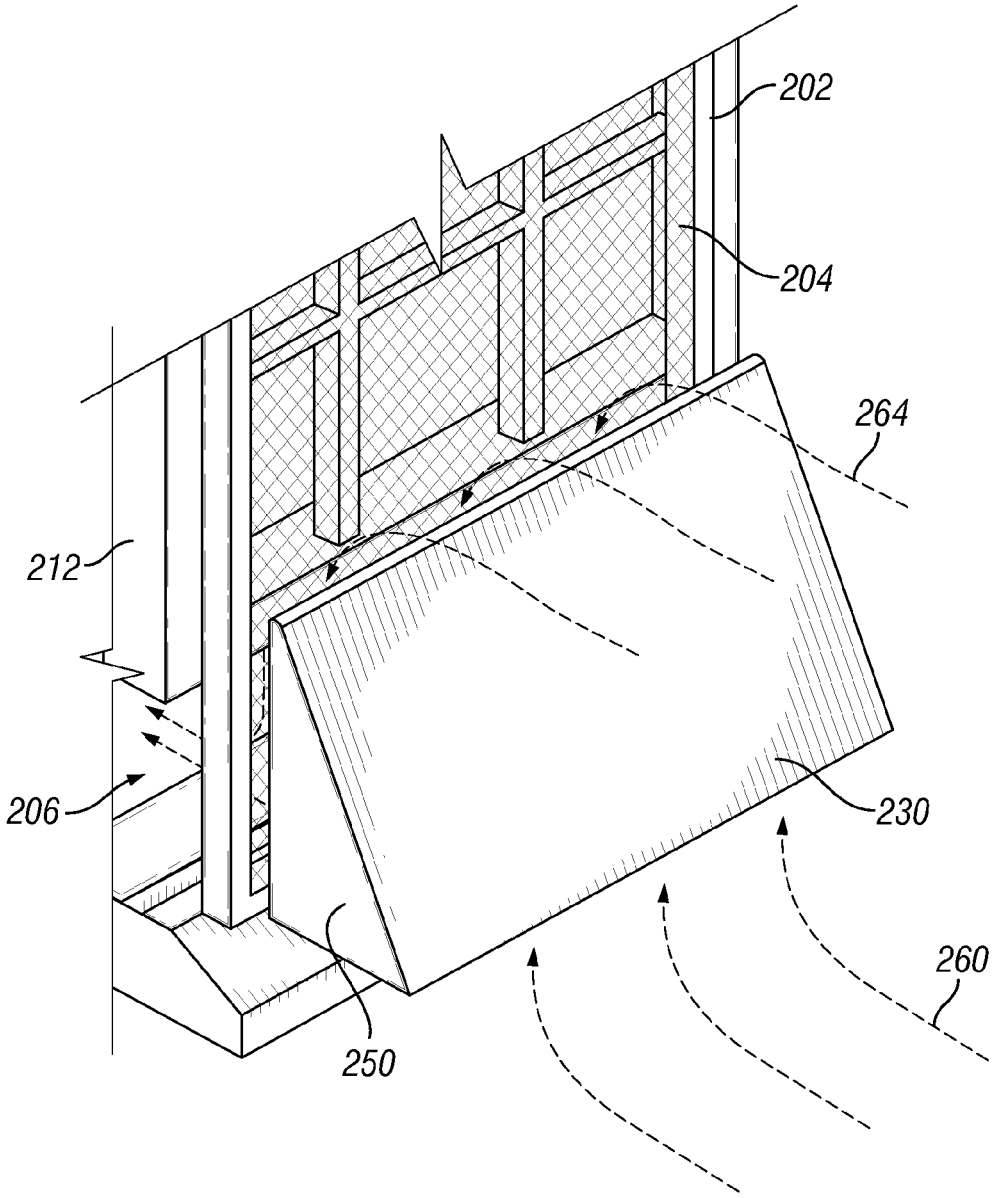
FIG. 3E shows another view of the exemplary system in FIG. 2.

In some embodiments as shown in FIG. 1G, the barrier 130 may be integrally formed with the window screen 120. In this embodiment, a barrier material can replace a portion of the air permeable barrier 122 forming the screen, and/or a barrier material can be permanently attached to the window screen during the manufacturing process. For example, the barrier 130 may be formed by having the fibers or wires forming the screen being tightly woven to form a solid or substantially solid mesh. The mesh may or may not have a water repellent coating to limit the passage of water through the screen. In some embodiments, the barrier 130 may be formed using a thermoset, thermopolymer, or other barrier type material that can be fused or bonded to the screen material. In still other embodiments, the screen material may be replaced with any of the barrier materials discussed herein along an edge or within a portion of the screen. In an embodiment, a portion of the screen material may remain between an edge of the screen and the barrier material to allow the screen to be mounted in the window screen frame. This may allow the barrier to be integrally formed with the screen material. In this embodiment, the screen material may be formed in rolls having the barrier material disposed along one side. Another embodiment may include the barrier material being disposed along two or more sides of the screen. The roll of screen material can then be used to form the window screen 120 with the barrier material in the proper position and/or a screen material for a screen door, a screened-in patio, or the like.

In some embodiments, the screen material may comprise vertical and/or horizontal stripes. The stripes may include screen fibers or strands of a different color or material and/or the stripes can be placed using a marking material (e.g., paint, ink, etc.). For example, the strips may be black or dark grey on a grey screen material. The strips may allow the screen material to be more easily aligned during construction of the window screens as well as providing a visual indication of the presence of the screen adjacent the window. Any type of material or color can be used to form the stripes. The stripes (occasionally referred to herein as indicator stripes) may also be operably disposed for safety purposes, specifically being configured to visually indicate the presence of a screen at least partially covering an opening and/or threshold of a window unit.

In the embodiment illustrated in FIGS, 1A-1J, the barrier 130, window 102, and window screen 120 are arranged to define an upper passageway 160. The upper passageway 160 may receive airflow that crosses a semi-permeable barrier (e.g., 122), where the airflow enters from above the upper portion 132*a* of barrier 130. The upper passageway 160 is defined between the interior surface of the barrier 130 and the exterior surface of the window 102. The upper passageway 160 is open to, and in fluid communication with, the atmosphere that is outside of the window screen 120. Airflow may be directed from the upper passageway 160 to the opening 106, and a portion of liquid may be removed in the airflow in response to directing the airflow to the opening 106.

While referred to as an upper passageway 160, the passageway between the barrier 130 and the window 102 may be vertical when a horizontally opening window is used. Further, the passageway may be along a lower edge of the barrier when a double hung window is opened along an upper edge of the window.

The span in which the upper passageway 160 runs may be characterized by a height ratio. The height ratio refers to a ratio of the height of the barrier 130 (i.e., barrier height 130*a*) above a base level (e.g., the base level of the mating surface 125) to the height of the opening 106 above the same base level (i.e., opening height 106*a*). The barrier 130 is configured to mitigate liquid passage across the threshold when the height of the barrier 130 is above the height of the opening 106. In an embodiment, the ratio of the height of the barrier 130 above a base to the height of the opening 106 above the same base level can be greater than about 1.2, greater than about 1.5, or greater than about 2.0. The height ratio may have an upper bound corresponding to decreasing the height of the opening 106*a*, while still maintaining at least some airflow through the opening. In general, the ratio of the height of the barrier 130 above a base to the height of the opening 106 above the same base level can be less than about 20. For example, the barrier 130 may have a height 130*a* of about 6 inches (e.g., about 15 centimeters (cm)), and the opening 106 may have a height 106*a* of about 5 inches (e.g., about 13 cm), thereby resulting in a 1.2 height ratio. In use, the window sash 109 can be moved to decrease the size of the opening 106*a* while the barrier is affixed to the window screen 104, or the window frame.

In some embodiments, system 100 further comprises an obstruction member 170*a* that is detachably retained in the window frame 104. The obstruction member 170*a* is configured to prevent the window from opening more than a desired amount. The obstruction member 170*a* may include a tube or rod having a square or round cross-section and may comprise a top and bottom lock that is configured to retain the obstruction member 170*a* in position relative to the window. Additionally, the obstruction member 170*a* may be plastic, metal, or a composite, and use a separate fastener to ensure that the obstruction member 170*a* stays in place. For example, an obstruction member 170*a* may use hook or loop type fastener with the corresponding loop or hook coupled to the window frame in order to allow the obstruction member 170*a* to be removeably coupled to the window frame 104. The obstruction members 170*a* (shown in FIGS. 1A and 1C), 170*b* (shown in FIGS. 1H-1J) may include a rigid member disposed within a window channel corresponding to the window 102 and plane 110 in which the window moves. The obstruction member 170*a* is placed at a predefined height that limits the ability of the window 102 to move any further in a direction within the window frame 104. For example, a plurality of obstruction members 170*a*, 170*b* may be used to limit the extent of the upwards movement of the window sash 109 in the vertical plane 110, thereby allowing the window sash 109 to move within a desired range of opening heights. When the window opens in another direction (e.g., horizontally, etc.), the obstruction members 170*a*, 170*b* can be used to limit the corresponding movement of the window sash 109 in the window frame. In an embodiment, the obstruction member 170*a* can be configured to ensure that the height of the opening 106*a* does not substantially exceed a distance that would fall below a desired height ratio. For example, if the barrier 130 has a height 130*a* of 6 inches (e.g., about 15 cm), then the obstruction member 170*a* may substantially impede movement of the window 102 when the opening height 106*a* reaches approximately 5 inches (e.g., about 13 cm). Thus, a lower height ratio threshold of 1.2 can be maintained to define the upper passageway 160 with the barrier 130. In an embodiment, the obstruction members 170*a*, 170*b* may include a longitudinally extended tube or rod with attachments such as hook and loop fasters or other attachments as discussed in FIG. 4A-4Q.

In an embodiment, the barrier 130 may comprise a shield member 134 that is rigidly coupled to the body member 132. The shield member 134 has a top portion 134*a* and a bottom portion 134*b*. The top portion 134*a* is rigidly attached to the upper portion 132*a* of the body member 132. The length of the shield member 134 may correspond to the length of body member 132. The shield member 134 may be angled downward relative to the upper portion 132*a* of the body member 132, thus making the bottom portion 134*b* be disposed below the upper portion 132*a*. Thus, a separation is defined between the bottom portion 134*b* of the shield member 134 and a lower portion 132*b* of the body member 132 which the inner surface 134*c* of shield member 134 so as to define a ceiling with the inner surface of 134*c* of shield member 134. In some embodiments, the shield member 134 may define a ceiling. The shield member 134 is disposed to provide a substantially water impermeable barrier within the predefined portion 123.

In some embodiments, the barrier 130 may further comprise a lower guard 134*d* that is coupled to the bottom portion of the shield member 134. The lower guard 134*d* may extend for a predefined distance towards the lower portion 132*b* of body member 132. The lower guard may be substantially perpendicular to the body member 132, or alternatively may be angled upwards, thus extending towards the middle of body member 132 and upper portion 132*a*. Additionally, the barrier 130 may comprise removeably coupled side plates that attach to each end of barrier 130, thereby forming a compartment between shield member 134 and body member 132.

Turning now to FIG. 2 and FIGS. 3A-3E, a system 200 for mitigating liquid passage across a threshold of a window unit is disclosed. The system 200 may comprise a window screen 202 that includes a semi-permeable barrier 204. The window screen 202 and semi-permeable barrier 204 may be the same or similar to window screen 120 and the air-permeable barrier 122 discussed with respect to FIGS. 1A-1J. The system 200 may comprise a window 210 that is surrounded by window frame 212 and is operable to define an opening 206. The window 210 may include a window sash 208 having a sealing surface 209, with the window sash 208 operating within a plane that defines the threshold of the opening 206. The opening 206 is between the sealing surface 209 and a mating surface 213 of the window frame 212 and defined on the sides by the frame. The mating surface 213 opposes and mates with the sealing surface 209. The mating surface 213 may comprise at least one of a window sill, a window channel, or a window casing. The lowering of the window 210 allows closure of the opening 206 when the window sash 208 is lowered along the plane of movement. The window screen 202 is coupled to the window unit and oriented substantially parallel to the window 210 so as to cover at least a portion of the window 210.

The system 200 comprises a liquid barrier that is coupled to the window screen 202. The liquid barrier 230 can be configured to be open to, and in fluid communication with, the atmosphere. The liquid barrier 230 can be exposed to rain or water because it is disposed outside of the window screen 202 and away (e.g., laterally offset) from the window 210. The liquid barrier 230 can be configured to direct a liquid away from window 210 and opening 206, and onto a portion of the window sill 214 that is oriented below the liquid barrier 230. The liquid barrier 230 comprises a first member 232, one or more sidewall members 250, an internal passageway 260, and a flange member 270. The first member 232 can have a first end 233 that couples to one sidewall member 250, and a second end 234 that couples to another sidewall member 250. In some embodiments, the sidewall members 250 are removeable end caps that prevent water from entering from end 233 and/or second end 234. Each sidewall member 250 has an outer surface 252 and an inner surface 254. The sidewall members 250 may define attachment openings to removably receive attachments and fasteners, as further discussed in FIG. 4. For example, a J-shaped spring clip may enter through one of the attachment openings and frictionally retain the liquid barrier 230 to the window screen 202, thereby allowing removable attachment of the liquid barrier 230. In some embodiments, a centerline 242 bisects the liquid barrier 230 between the first end 233 and second end 234, and thus may be substantially mirrored in dimensions, or may be unique to the dimensions of the window 210.

The liquid barrier further has a top portion 235 that is disposed above the bottom portion 236. The liquid barrier 230 also has an inner surface 238, an outer surface 237, and a length that corresponds with the width of the opening 206 (i.e., the span between first end 233 and second end 234). In some embodiments, the first member 232 defines a slot 240 that is defined between the top portion 235, bottom portion 236, inner surface 238, and outer surface 237. The slot 240 has a width 240*a* that is defined to accept a printed graphic sheet 290. The liquid barrier 230 (including the first member 232) may be clear, transparent, and/or semi-opaque to allow a printed graphic 290 to be viewed through the liquid barrier 230. The liquid barrier may also include flange members 270 that are coupled to each sidewall 250. Each flange member 270 can extend towards the centerline 242 and has a surface 272 that is configured to correspond with the window screen 202 for coupling the liquid barrier 230 to the window screen 202. Thus, where the window screen 202 is disposed substantially parallel to the window 210, then the flange members 270 are configured to mate and be substantially parallel to the window screen 202 and/or semi-permeable barrier 204 thereof.

In some embodiments, the system 200 may further comprise an internal passageway 260 that can receive an airflow from below the liquid barrier 230. The internal passageway 260 comprises a ceiling 262 and sides. The ceiling 262 that is defined by the inner surface 238 of the first member 232. The sides of the internal passageway 260 are defined by the respective inner surfaces 254 of the sidewall members 250 on the first end 233 and second end 234. Thus, the liquid barrier 230 is configured to define upper passageway 264 between the first member 232 and the window 210, and in some embodiments, the upper passageway 264 may he substantially similar to the discussion of upper passageway 160 in FIGS. 1A-1J. The upper passageway 264 is in fluid communication with the internal passageway 260, and both passageways 260 and 264 are in fluid communication and open to atmospheric pressure. Thus, the liquid barrier 230 directs a gas (e.g. air) into a fluid flow path through the upper passageway 264 and directs a gas (e.g., air) into the internal passageway 260 from under the liquid barrier 230.

In some embodiments, the liquid barrier 230 comprises a surge deflector 280 and a cavity shield 282. The surge deflector 280 may include a lip that protrudes from the exterior surface 235 of the first member 232. The surge deflector 280 may be defined to redirect liquid away from the first member 232 so that wind does not blow rain up the first member 232 and into the upper passageway 264. The cavity shield 282 may be disposed between the sidewall members 250 and protrude from the first member 232 and towards the flange members 270. The cavity shield 282 is configured to deflect water from entering the internal passageway 260 and remove liquid from a fluid flow path that is traveling through the internal passageway and across the opening. In some embodiments, the first member 232 may define an opening in the bottom portion 236 that extends between the inner surface 238 and outer surface 237. This opening in the bottom portion 236 may allow a passage of air, but block the entry of fluid, into the internal passage 260 due to the cavity shield 282 being disposed at an upward angle towards the top of the liquid barrier 230. It is understood that the liquid barrier 230 may be affixed to the window screen 202 via various mechanisms as illustrated in FIG. 4A-4Q.

Figure 4A:
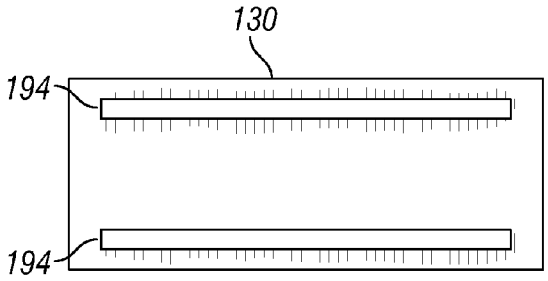
FIGS. 4A-4D and 4F-4M illustrate exemplary attachment mechanisms and attachment locations implemented in embodiments of the disclosure, including embodiments shown in FIGS. 1A, 1B, 1D, and 1G.
Figure 4B:
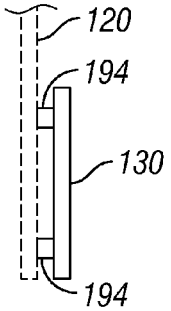
Figure 4C:
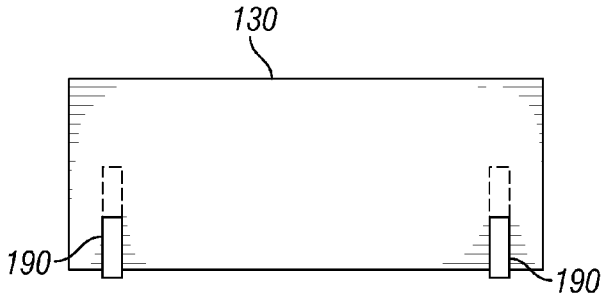
Figure 4D:
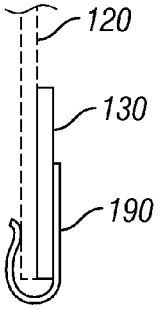
Figure 4E:
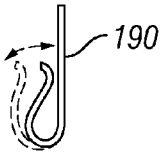
FIG. 4E illustrates an exemplary attachment mechanism for use in various embodiments of the present disclosure, including in FIGS. 4C, 4D, 4H, 4I, 4N, and 4O.
Figure 4F:
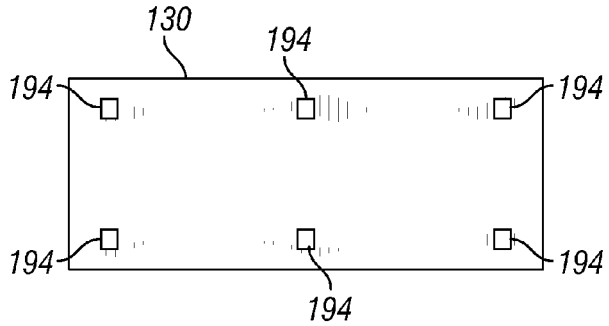
Figure 4G:
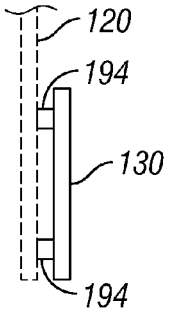
Figure 4H:
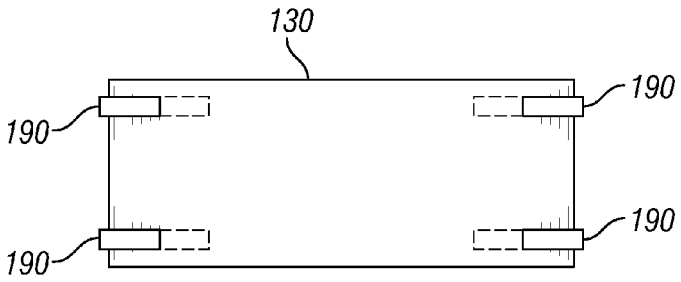
Figure 4I:
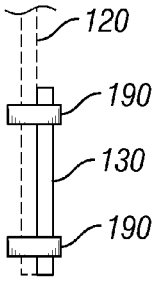
Figure 4J:
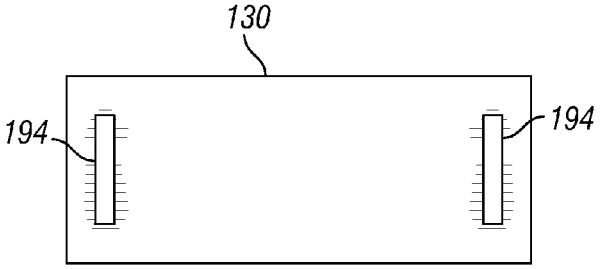
Figure 4K:
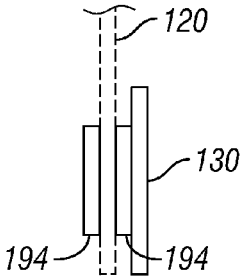
Figure 4L:
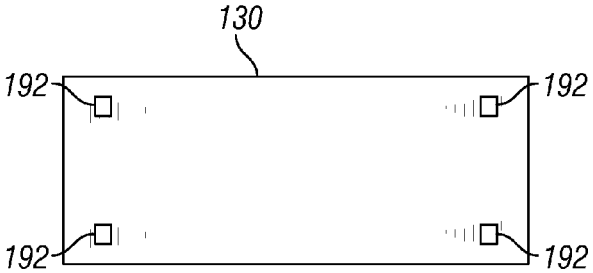
Figure 4M:
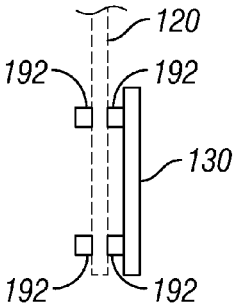
Figure 4N:
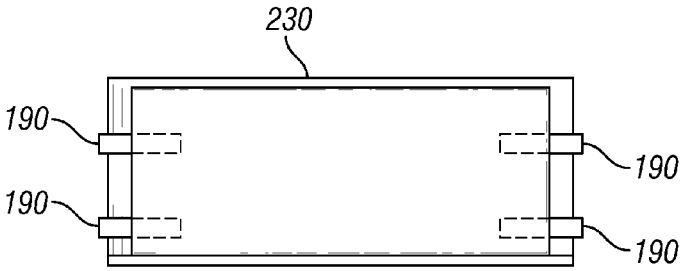
FIGS. 4N-4Q illustrate additional exemplary attachment mechanisms and attachment locations according implemented in embodiment of the disclosure, including in FIGS. 2, 3A, 3B, 3D, and 3E.
Figure 4O:
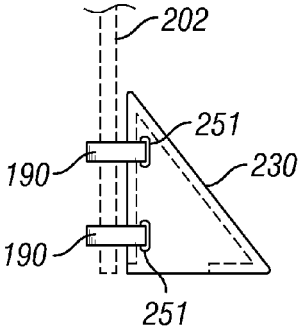
Figure 4P:
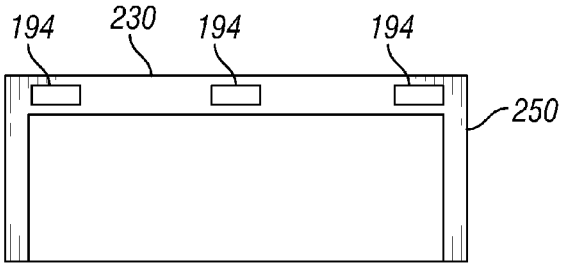
Figure 4Q:
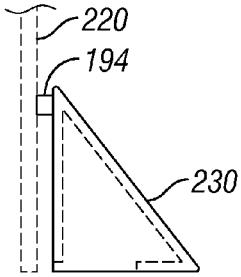

Turning now to FIGS. 4A-4Q, embodiments of attachment mechanisms for barriers are disclosed. As discussed above, the barriers (e.g., 130 and 230) may be configured to be affixed to a window screen without preventing closure of the window within the frame. This means that the window can be closed by operation of the window sash mating the sealing surface with the mating frame surface. The barrier 130, 230 may be fastened to the screen and may include a stand-off section in the center of the portion attaching to the window screen in order to keep the barrier centered and from bulging along a centerline (e.g., as shown in FIGS. 4F, 4P). The barrier may be coupled to the window screen (e.g., 120, 202) and may be removable. For example, the barrier may use hook and loop type fasteners, locking fasteners, spring clips (e.g., as shown in FIGS. 4C-4E, 4H, and 4I), or magnetic members 192 at predefined portions of the barrier. In some embodiments, a spring clip 190 (e.g., plastic or metal J-Clips) may be fixed to the window screen and/or window frame, and the barrier may be able to slide into the spring clip 190. For example, barrier 230 may comprise sidewall members 250 that define attachment openings 251 for J-Clips 190 to slide into and retain the barrier 230 to window screen 202 or 120. Thus, the barrier may be held in place by frictional force and thus does not alter the physical structure of the window frame or prevent functionality of the window's ability to close.

The barrier may be affixed at locations 194 in long continuous sections (e.g., as shown in FIGS. 4A-4B), shorter intermediate locations (e.g., as shown in FIGS. 4F-4G, 4J-4K), or at predefined portions corresponding to the configuration of the window screen. For example, it is contemplated that locations 194 may comprise attachment mechanisms such as at least one of a double-sided adhesive tape, a plurality of hook and loop fasteners, locking fasteners, spring clips, hooks, magnetic members, or a bonding agent. Fasteners and attachments mechanisms discussed herein may include attaching one side to the window screen, while being able to removeably couple the barrier with a complementary fastener. For example, the window screen may have the pile side (loop portion) of the hook and loop fastener, while the barrier may have the hook side. Similarly, a window screen may be fitted with one polarity of a magnetized material and/or simply a ferromagnetic material, while the barrier is affixed with the complementary polarity of a magnetized material in order to removably couple the two components together. Examples of bonding agents may include two-part epoxy, silicone, or other type of glue/adhesives with outdoor, moisture, and/or UV resistant properties. In some embodiments, the barrier may be integrally formed with the screen and may not require a separate attachment mechanism.

It is understood that a barrier may be about 3 inches (e.g., about 7.6 cm) to about 10 inches (e.g., about 25 cm) in height, between about 4 inches (e.g., about 10 cm) and 8 inches (e.g., about 20 cm) in height, or between about 5 inches about 13 cm) and about 7 inches (e.g., about 18 cm) in height, but may vary on the configuration of the window. Thus, the weight of the barrier corresponds with the type of material being used, and thus the amount and placement of attachment mechanisms discussed here will be configured accordingly. In some embodiments, a window screen may be affixed with a magnetic member that is secured to one side of the window screen, and thereby allowing for easy placement, and removal of the barrier from the window screen. Additionally, embodiments of the systems 100 and 200 discussed herein may comprise a plurality of materials, including, but not limited to, polyethylene, polypropylene, polyvinyl chloride (PVC), styrene, acrylic, Lexan, and the like, and/or other plastic sheeting or film that is substantially impermeable to water. Some embodiments may also employ the use of Aluminum (either anodized or painted), moisture resistant treated wood, or other metal sheeting or pulp products with moisture resistant properties.

In use, the liquid barrier can be used to prevent or limit water from entering through the opening in the window. For example, the barrier may allow the window to be open while it is raining without allowing the rain into the interior of the structure. The liquid barrier can be affixed to the window screen according to any of the embodiments described herein. The liquid barrier can cover a predefined portion of the window screen, which is disposed adjacent to and over the window (e.g., adjacent to the window frame). The opening can be defined within the plane of the window. The liquid barrier 230 may have a height 239 above the opening height. In an embodiment, the ratio of the liquid barrier height 239 above a base level to the opening height above the base level can be greater than about 1.2. In an embodiment, the opening 206 may be initially defined by adjusting the window sash to set the opening height.

As the airflow passes from the exterior of the structure to the interior of the structure, the airflow may pass over the barrier and along a downward flowpath to pass under the window through an opening. For example, the airflow may be deflected through the window screen, and then downward through an upper passageway defined between the liquid barrier and the window before passing into the opening. While not intending to be limited by theory, it is believed that the airflow can change direction more easily than the water droplets. The momentum of the liquid droplets may carry the liquid in the airflow towards and cause the liquid droplets to impinge on the liquid barrier and/or the window. The resulting contact with the liquid barrier and/or the window may cause the liquid to run along the surface of the liquid barrier and/or the window and drain away from the opening. For example, water impacting the liquid barrier may run down the liquid barrier and drip on the window sill. Similarly, water impacting the window can run down the window and drip on the window sill. The water can then be directed to the exterior of the structure from the window sill. Thus, a portion of the liquid in the airflow may be removed based on the initial deflection of the airflow over the liquid barrier.

The air may then be directed from the upper passageway to the opening. The second change of direction may result in an additional portion of the liquid in the airflow being removed. For example, any remaining liquid may impinge on the window and/or the outside of the window sill in response to changing direction into the opening. The airflow can then be received through the opening with the liquid substantially removed.

When the liquid barrier comprises an interior flowpath, the air may enter the lower portion of the liquid barrier and pass through the interior flowpath before entering the opening. Within the interior flowpath, the airflow may change direction. As with the air flowing over the liquid barrier, the change in the direction of the airflow may cause any liquid to impinge on a surface and flow out of the pathway, thereby removing the portion of the liquid from the airflow. This may allow the airflow to pass through the opening with the liquid substantially removed.

Figure 5A:
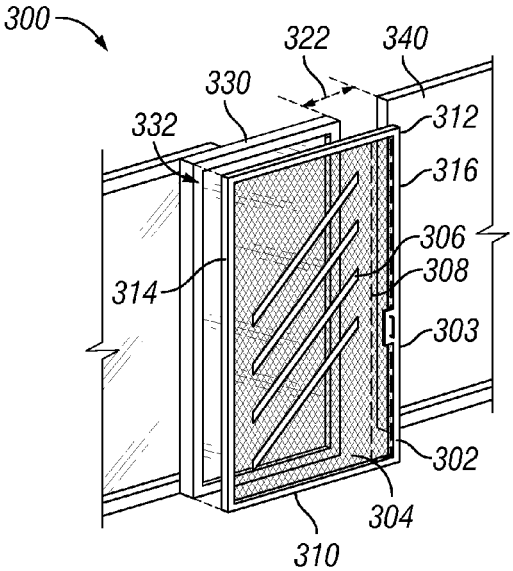
FIG. 5A illustrates another exemplary system according to an embodiment of the disclosure.
Figure 5B:
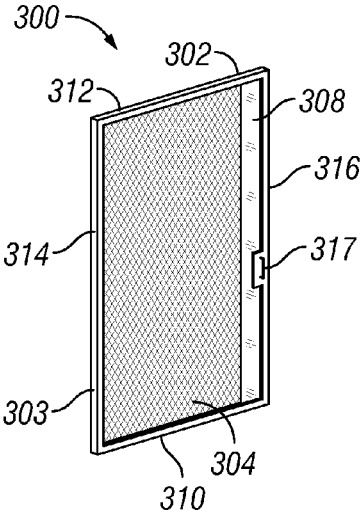
FIG. 5B illustrates an exemplary screen door for use in various embodiments of the present disclosure, including the system of FIG. 5A.
Figure 5C:
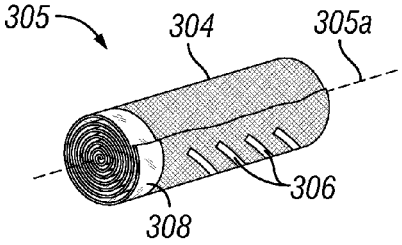
FIG. 5C illustrates an exemplary screened barrier unit suitable for implementation in various embodiments of the present disclosure, including embodiments in at least FIGS. 5A, 5B, and 5D.

Turning now to FIGS. 5A-5C, a liquid mitigation system is disclosed. In this system, the screen material having stripes and/or a barrier material may be used with structures that are not directly adjacent to a window or a window opening. For example, the material can be used to form a screen for a screen door or a screened in patio. The stripes may serve to provide a visual cue that the screen is in place, which may aid in avoiding contact with the screen. The barrier may be used to prevent the ingress of water to some degree. For example, the barrier can be placed along a lower edge of the screen to block rain that can splash into the screen when it drips on an adjacent surface. Thus, the screen material incorporating stripes and/or a barrier material may be useful for a variety of purposes.

In an embodiment, the system 300 comprises a screened barrier unit 305. The screened barrier unit 305 includes a screen 304 (e.g., a screen material, a semi-permeable membrane, a mesh material, an air-permeable barrier, etc.) and at least one of an indicator stripe 306 or barrier 308. It is understood that screen 304 may be substantially similar to the screen material (e.g., semi-permeable barrier and air-permeable barrier) discussed above in FIGS. 1A-1G. Additionally, barrier 308 may include features substantially similar to liquid barrier and/or substantially water impermeable barrier as discussed above. The screened barrier unit 305 may be manufactured independent of a frame (e.g., frame structure 303) that couples to an edge portion of the screened barrier unit 305. Thus, prior to being incorporated into a particular frame arrangement, the screened barrier unit 305 may be rolled into a cylindrical shape, such as along axis 305*a* as illustrated in FIG. 5C. This allows the screened barrier unit 305 to be segmented, cut, and/or manufactured into a variety of defined shapes, and/or may be stacked prior to assembly and/or installation with a frame (e.g. frame structure 303). For example, the screened barrier unit 305 may be cut into the shape of a quadrangle for use in a screen door (e.g., as seen in FIGS. 5A and 5B) or for use in a window screen discussed above in FIGS. 1A-1G.

As discussed above with respect to FIGS. 1A-1G, the screen 304 may be a woven fiber or wire forming a semi-permeable membrane, such as permeable to air and/or vapors. The screen 304 is operable in conjunction with barrier 308. The barrier 308 may be removeably coupled, affixed, and/or permanently attached to a predefined portion of the screen (e.g., air-permeable barrier 304 and/or surrounding frame structure such as 303), thereby replacing the section of the screen 304. In some embodiments, the barrier 308 is made of a different material than the screen 304. For example, the barrier 308 may include a substantially water impermeable material (which may be substantially transparent, semi-opaque, and/or opaque), while the screen 304 includes a wire or woven mesh. Alternatively, in some embodiments as shown in FIGS, 5A-5D, the barrier 308 may be integrally formed with the screen 304 (e.g., semi-permeable and/or air permeable barrier). In this embodiment, a barrier material of barrier 308 can replace a portion of the air permeable barrier forming the screen 304, and/or a barrier material can be permanently attached to the screen 304 during the manufacturing process. For example, the barrier 308 may be formed by having the fibers or wires forming the screen being tightly woven to form a solid or substantially solid mesh over a predefined portion. The mesh at this predefined portion may or may not have a water repellent coating to limit the passage of water through the screen. In some embodiments, the barrier 308 may be formed using a thermoset, thermopolymer, or other barrier type material that can be fused or bonded to the screen material of screen 304. In still other embodiments, the screen material may be replaced with any of the barrier materials discussed herein along an edge or within a portion of the screen 304. In an embodiment, a portion of the screen material may remain between an edge of the screen and the barrier material to allow the screen to be mounted in the frame 303 (and thus screen door 302). This may allow the barrier 308 to be integrally formed with the screen material. In this embodiment, the screen material may be formed in rolls having the barrier material disposed along one side, as discussed above and illustrated in FIG. 5C. Another embodiment may include the barrier material being disposed along two or more sides of the screen. The roll of screen material (e.g., screened barrier unit 305) can then be used to form the window screen 120 with the barrier material in the proper position. For example, the barrier material can be aligned along a defined opening and/or threshold and/or along the bottom of the screen to prevent liquid from entering the screened in area.

A screen door 302 may be disposed based on the respective orientation of a door (e.g. sliding door 330) so as to be substantially congruous and/or parallel to the operation of the door. Specifically, the screen door 302 may include the screen 304 with the barrier 308 and/or indicator stripes 306 positioned to cover at least a portion of an opening 322 defined by the door 330. It is understood that screen door 302 may include edges defined by frame 303. As illustrated in FIGS. 5A and 5B, the screen door has a lower portion 310, upper portion 312, first end 314, and second end 316. The screen door 302 may be moveable along a plane relative to the articulation of the door. The screen door 302 may include a handle 317 that is configured to aid in movement of the screen door 302, and/or engage a securing mechanism with an adjacent structure (e.g., wall or door frame) and/or other latching mechanism of door 330. Thus, when screen door 302 is horizontally moved, an opening 322 is created between the wall 340 and the sliding door 330. Because the screen door 302 is offset from the sliding door 330, the door can be adjusted to define a distance of the opening 322. This opening distance may be referred to as an opening height. Thus, the barrier 308 includes a corresponding barrier height that is configured to define a ratio between the height of the barrier and the height of the opening as greater than 1.0 and less than 20. Therefore, the barrier 308 is configured to cover an opening (e.g., door opening 322) defined by the door and provide a substantially water impermeable barrier over the predefined portion.

In some embodiments, the screen material (e.g., screen 304 and/or screened barrier unit 305) may comprise indicator stripes 306 (e.g., vertical and/or horizontal stripes relative to a door or opening). The stripes 306 may include screen fibers or strands of a different color or material and/or the stripes can be placed using a marking material (e.g., paint, ink, etc.). For example, the stripes may be black or dark grey on a grey screen material. The stripes may allow the screen material to be more easily aligned during construction of the screen unit (e.g., screen door 302) as well as providing a visual indication of the presence of the screen adjacent the door. Any type of material or color can be used to form the stripes. The stripes 306 may also be operably disposed for safety purposes and thus act as a visual indicator that a screen is at least partially covering an opening. This aids in preventing a person from walking through a door opening while the screen door 302 is at least partially covering the opening. The stripes can be spaced at any distance to allow them to be visually perceived. In an embodiment, the stripes may be spaced apart between about 0.5 inches (e.g., about 1 cm) and about 24 inches (e.g., about 61 cm). The stripes can be oriented in any direction such as vertically, horizontally, and/or any orientation between a vertical and horizontal alignment. Further, the stripes can have a width or thickness to allow them to be visually perceived. The color, contrast, and material used to form the stripes may affect how thick the stripes are so that they can be visually perceived. In an embodiment, the thickness of the stripes may range from the thickness of a single strand of woven material to about 4 inches e.g., about 10 cm), or between about 0.06 inches (e.g., about 0.15 cm) to about 2 inches (e.g., about 5 cm).

While illustrated as having both the barrier material and the stripes, it should be understood that the screen barrier unit may only comprise the stripes for use in aligning the screen material during production of the screen in a frame as well as providing a safety function to indicate the presence of the screen. Thus, in some embodiments, the screened barrier unit may only comprise a screen material with stripes as described above without the barrier material.

Figure 5D:
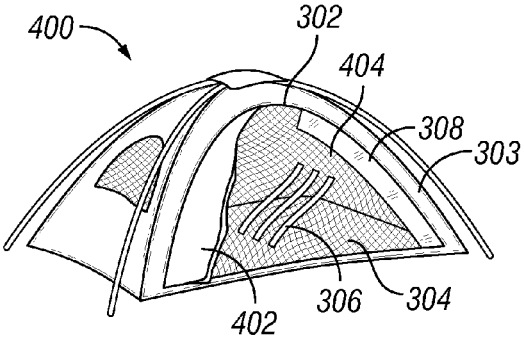
FIG. 5D illustrates one embodiment of a portable enclosed structure for implementing various embodiments of a screened barrier unit from FIG. 5C.

Additionally, in alternative embodiments such as seen in FIG. 5D, the screened barrier unit 305 may be configured for use in a portable enclosed structure, such as camping tent 400 that includes a tent door 402. The screened barrier unit 305 may be cut in the shape of an arc so as to be congruous and align with the shape of the tent door 402, while also coupling to a frame such as a locking clasp (i.e., a zipper) and/or hook and loop fastener members (e.g., Velcro strips). Thus, the liquid barrier 308 may provide a substantially water impermeable barrier over an opening 404 defined by the tent door 402.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented. The particular naming of the components, capitalization of terms, the attributes, structures, or any other structural aspect is not mandatory or significant, and the mechanisms that implement the disclosure or its features may have different names, formats, or protocols. Also, the particular division of functionality between the various components described herein is merely exemplary, and not mandatory; functions performed by a single system component may instead be performed by multiple components, and functions performed by multiple components instead may be performed by a single component. Finally, it should be noted that the language used in the specification has been principally selected for readability and instructional purposes, and may not have been selected to delineate or circumscribe the subject matter.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.), For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A system for mitigating liquid passage across a threshold of a window unit, comprising:

a liquid barrier configured to be coupled to a window screen adjacent to a window within a frame, wherein the liquid barrier comprises:

a first member comprising: a first end, a second end, a top portion, a bottom portion, an outer surface, an inner surface, and a slot defined along a length and between the top portion, bottom portion, outer surface, and inner surface, wherein the length is the dimension between the first end and the second end;

a sidewall member coupled upon, and transversely aligned to, each of the first end and second end of the first member, wherein each sidewall member comprises an outer surface and an inner surface;

an internal passageway having a ceiling and sides, the ceiling and sides being defined by the inner surfaces corresponding with each of the first member and each of the sidewall members; and a flange member coupled to each sidewall member, wherein each flange member respectively: extends from the inner surface of the corresponding sidewall member, extends towards a centerline of the first member, is dimensioned to overlap and mate to the window screen, and is configured to affix the liquid barrier to the window screen along a surface of each flange member that is substantially parallel to the window screen.

2. The system of claim 1, wherein the first member is dimensioned to overlap a predefined portion of the window screen, and wherein the first member is configured to provide a fluid barrier along the outer surface and across the window screen within the predefined portion.

3. The system of claim 1, wherein the slot is configured to removeably receive a substantially flat sheet having a thickness that is less than a width of the slot.

4. The system of claim 1, further comprising: a plurality of obstruction members detachably coupled to the window frame, and wherein each obstruction member is configured to impede movement of the window within the window frame above a threshold opening height.

5. The system of claim 1, wherein the window comprises a window sash, wherein the window sash is configured to define the opening between a sealing surface of the window sash and a mating surface of the window frame.

6. The system of claim 5, wherein the liquid barrier is in fluid communication with the atmosphere and is configured to be affixed to the window screen without preventing closure of the window via operation of the window sash mating the sealing surface with the mating surface, wherein the liquid barrier and the window define an upper passageway between the first member and the window, wherein the upper passageway is in fluid communication with the internal passageway, and wherein the liquid barrier is operative to: direct a gas along a fluid flow path into the upper passageway and an internal passageway through the opening defined by the window, wherein the liquid barrier is further configured to direct a liquid away from the window and onto a portion of the window sill below the liquid barrier and outside of the opening.

7. The system of claim 5, wherein the liquid barrier is configured to affix to the window screen via at least one of a double-sided adhesive tape, a plurality of hook and loop fasteners, locking fasteners, spring clips, hooks, magnetic members, or a bonding agent.

* * * * *